United States Patent [19]

Krauter et al.

[11] Patent Number: 4,820,551

[45] Date of Patent: Apr. 11, 1989

[54] METHOD FOR FABRICATING THERMO-INKING RIBBONS FOR THERMO-TRANSFER PRINTING, AND THERMO-INKING RIBBON OBTAINED THEREBY

[75] Inventors: Heinrich Krauter, Neustadt; Albert Schmedes, Pattensen; Norbert Mecke, Hanover; Wieland Kuchenreuther, Isernhagen, all of Fed. Rep. of Germany

[73] Assignee: Pelikan Akteingesellschaft, Hanover, Fed. Rep. of Germany

[21] Appl. No.: 15,056

[22] PCT Filed: Jun. 4, 1986

[86] PCT No.: PCT/EP86/00335

§ 371 Date: Feb. 3, 1987

§ 102(e) Date: Feb. 3, 1987

[87] PCT Pub. No.: WO86/07311

PCT Pub. Date: Dec. 18, 1986

[30] Foreign Application Priority Data

Jun. 7, 1985 [DE] Fed. Rep. of Germany ..... 3520308

[51] Int. Cl.[4] ..... B41M 3/12

[52] U.S. Cl. ..... 427/146; 428/195; 428/207; 428/484; 428/488.1.; 428/913; 428/914

[58] Field of Search ..... 427/146; 428/195, 207, 428/484, 488.1, 913, 914

[56] References Cited

U.S. PATENT DOCUMENTS 2,872,340 2/1959 Newman et al. .
3,287,153 11/1966 Schwarz et al. .
3,935,362 1/1976 Tat-Hin Sund et al. .
4,296,150 10/1981 Mecke et al. .
4,309,117 1/1982 Chang et al. ..... 400/241.1
4,592,945 6/1986 Mecke et al. ..... 428/195
4,661,393 4/1987 Uchiyama et al. ..... 428/200
4,675,063 6/1987 Mecke et al. ..... 156/234

FOREIGN PATENT DOCUMENTS 984216 2/1965 United Kingdom .

OTHER PUBLICATIONS

IBM Technical Disclosure Bulletin, vol. 27, No. 3, Aug. 1984.

*Primary Examiner*—Ellis P. Robinson
*Assistant Examiner*—P. J. Ryan
*Attorney, Agent, or Firm*—Herbert Dubno

[57] ABSTRACT

A reusable thermocolor ribbon for thermal transfer printing is described comprising a layer of a melt-applied color on one side of a plastic foil as carrier, where the melt-applied color contains a wax or wax-like substance, a pigment and an organic binder. A coating liquid which contains a thermoplastic binding agent in solution and the meltable wax or wax-like substance in finely dispersed solid form, is applied to the carrier of the thermocolor ribbon, where the coating liquid represents as solvent agent a mixture of a solvent and non-solvent for the thermoplastic binding agent at room temperature. The non-solvent/solvent mixture is evaporated while simultaneously its solvent capability for the plastic binding agent is reduced. This thermocolor ribbon can be used more than 20 times without impairment of the print quality. A process for preparing the thermocolor ribbon is also detailed herein.

4 Claims, No Drawings

METHOD FOR FABRICATING THERMO-INKING RIBBONS FOR THERMO-TRANSFER PRINTING, AND THERMO-INKING RIBBON OBTAINED THEREBY

CROSS-REFERENCE TO RELATED APPLICATIONS

This application is a National Phase application of PCT/EP 86/00 335 filed June 4, 1986 and based, in turn, upon German National application PE 35 20 308.0 filed 7 June 1985 under the International Convention.

FIELD OF THE INVENTION

The invention concerns a thermocolor ribbon for thermal-transfer printing and a process for the production of this ribbon, the ribbon comprising a layer of a melt-applied color on one side of a plastic foil as carrier, where the melt-applied color contains a wax or a waxlike substance, a coloring agent and an organic binding agent.

BACKGROUND OF THE INVENTION

Thermocolor ribbons usually comprise a foil-like carrier which may, for instance, consist of paper or plastic, and a layer of a melt-applied color, particularly in the form of a layer of coloring agent or carbon black bound to wax. In these thermocolor ribbons, the melt-applied color is melted by means of a thermal printing head, and transferred to a recording paper. In this instance, one speaks generally of a TCR ribbon ("Thermal Carbon Ribbon"). Thermal printers which impress a thermal character during the printing process are known, e.g. from DE-OS 2 062 494 and 2 406 613 as well as from DE-OS 3 224 445. During the printing process, the procedure is, in detail, as follows: the print head of a thermal printer presses the thermocolor ribbon against the recording paper, thereby causing the print head to develop temperatures which may maximally lie at about 400° C. The uncoated backside of the thermocolor ribbon or the foil-like carrier is, during the printing operation, in direct contact with the print head or the thermal symbol formed thereon. At the instant of the printing operation proper, the relative speed between the thermocolor ribbon and the printing paper is zero. The melt-applied color is transferred from the thermocolor ribbon to the printing paper through a melting process in the shape of the character to be imprinted. Upon disengagement of the thermocolor ribbon, the melted symbol remains attached to the printing paper and solidifies.

In addition to the thermocolor ribbons described above, with simple foil-like carriers, there are also thermocolor ribbons where the thermal symbol is created not by a thermal print head, but by the resistive heating of a specially designed foil-like carrier. The melt-applied color, which is the "operative layer" during the printing process, also contains the materials enumerated above. Within the art, the foregoing is called an "ETR" thermocolor ribbon ("Electro Thermal Ribbon"). A thermotransfer-printing system of this type is described in U.S. Pat. No. 4,309,117.

Thermocolor ribbons are already known which print several times (i.e. they are designed for multi-use). Such thermocolor ribbons are described, for instance, in EP-A 0 063 000. In accordance therewith, the melt-applied color of the thermocolor ribbon is of particulate material, which is insoluble in the solvent of the coating liquid and does not melt below 100° C., and further incorporates a particulate material with a melting point between 40° and 100° C. The particulate material not melting below 100° C. should preferably be a metal oxide, a metal, organic resin or carbon black. The layer os the melt-applied color which represents a solid mixture shall, by means of said special particulate material, receive a heterogeneous structure, which allows only a small quantity of the molten material to be transferred to be used-up during a single printing operation.

In connection with the known thermocolor ribbons, it has become evident that improvements are needed in their printouts.

SUMMARY OF THE INVENTION

It is, therefore, the object of the invention to further develop the process described initially, so that a thermocolor ribbon becomes available which produces particularly sharp imprints.

SUMMARY OF THE INVENTION

In accordance with the invention, the object is attained in that a coating liquid which contains a thermoplastic bonding agent in solution and a meltable wax or waxlike substance in finely dispersed solid form, is applied to the carrier of the thermocolor ribbon. The coating liquid must comprise a mixture of both a solvent and a nonsolvent for the thermoplastic binding agent at room temperature. This nonsolvent/solvent mixture is continuously evaporated which simultaneously reduces solvation for the thermoplastic binding agent.

The essence of the invention consists, therefore, in incorporating a thermoplastic binding agent in the melt-applied color in a predetermined manner to obtain a thermocolor ribbon rendering particularly sharp characters.

DETAILED DESCRIPTION

For the purposes of the invention, any available plastic foil may be employed which is utilized as a carrier for conventional carbon ribbons for typewriters. Of course, the foil must withstand said high temperatures during the short-term printing operation, and at these temperatures must freely liberate the melt-applied color on the heated spot. In particular, the plastic foil consists of thermoplastics of higher glass transition temperature. In this context, the following are preferential materials: polyesters (particularly polyethyleneterephthalates), polycarbonates, polyamides, polyvinyl compounds (particularly polyvinyl chloride), polyvinyl acetate, polyvinyl alcohol, polyvinyl proprionate, polyethylene, poly- propylene and polystyrene. The plastic foil to be utilized in accordance with the invention can be one which consists of a web with plastic laminated to one or both sides. It goes without saying, that in the framework of the invention, other similar plastic foils can be utilized which are familiar to the expert.

In some cases, it is advantageous to incorporate a softening agent into the carrier foil selected in order to attain improved flexibility. Furthermore, a substance can be added which enables thermal conductivity. The thickness of the plastic foil will be determined by prevailing conditions. As a rule, however, it will be relatively thin e.g. 3 to 6$\mu$, in order to permit the necessary heat transfers to take their course optimally. Of course, said range of thickness can be reduced or exceeded.

In the context of the invention, the generic term "wax" is to be understood in its broadest sense. As a rule, such material shall have the following properties: at 20° C. not kneadable, solid to brittle-hard, coarse to fine crystalline, transparent to opaque, but not glass-like, meltable above 40° C. without dissociation, but already slightly above the melting point of comparatively low viscosity, and not ropy. In the context of the invention. "waxlike substances" shall be understood to be materials largely similar to waxes as regards physical and chemical properties. This can also include materials which melt below 40° C., but which exhibits in molten state similar or equal properties which appear in waxes above 40° C.

The coating liquid contains the wax or waxlike material in finely dispersed solid form. Particle size lies thereby regularly in the range from about 0.1 to 2 μm. According to the invention, particularly good process results are obtained in this range of particle size. The suspension of these materials can be effected in various ways. This can occur, for example, by means of suspending of fine particles of these materials, by emulsifying in the melt and subsequent cooling, and also be dissolving in solvent under heat with subsequent cooling the precipitate solid material.

A thermoplastic is an essential component of the layer of melt-applied color under the invention. At normal temperature, thermoplastics are hard or even brittle plastics, which under application of heat soften reversibly and become easily deformable by mechanical means until finally transforming into a viscous liquid at high temperatures. Thermoplastics pass through a range of softening and melting. According to the invention, they must be soluble in the dispersion means (solvent/nonsolvent) at room temperature. Considering these requirements, it is easy for the expert to select suitable thermoplastic binder materials. These include, e.g. polystyrene, polyvinyl acetate, polyvinyl acetal, polyvinyl chloride, copolymers of vinyl acetate and vinyl chloride as well as cellulose acetobutyrate.

In the melt-applied layer realized according to the invention, the thermoplastic binding agents serve as a structure substance. For the control of the hardness of this structure substance in the completed melt-applied color suitable known softeners or plasticizers can be incorporated therein, e.g. phthalic acid esters such as di-2-ethylhexyl phthalate, di-isonyl phthalate and di-isodecyl phthalate, aliphatic dicarbonic acid esters, such as esters of adipic acid, particularly di-2-ethylhexyl adipate and diisodecyl adipate, phosphates such as tricresyl phosphate and triphenyl phosphate, esters of fatty acids such as triethylene glycol-2-(2-ethyl butyrate) and similar materials.

In special cases, it can also be advantageous to incorporate stabilizers into the thermoplastic binding agents.

The ratio between wax or waxlike substances and the thermoplastic binding agent in the coating liquid can vary widely and is not critical to the practice of the invention. The ratio of weights can easily lie between about 10:1 and 1:2. A weight ratio of about 5:1 to 1:1 is preferred.

The solids content of the originally used coating liquid or initial solution can also vary in a wide range, e.g. between say 20 and 80 percent by weight, preferably between about 30 and 60 percent by weight.

As nonsolvents for the thermoplastic binding agent of the coating liquid, where adjustments are made for conditions at room temperature, aromatic, cycloaliphatic and branched as well as unbranched hydrocarbons, substituted and non-substituted, are to be considered. Thereby the aliphatic and cycloaliphatic petroleum constituents play a special role, particularly raw gasoline and its partial fraction in the form of petrol ether, light gasoline, ligroine (lacquer gasoline), heavy gasoline, kerosene, i.e. the second main fraction of crude oil subjected to fractional distillation, which contains paraffin hydrocarbons with from 9 to about 20 carbon atoms, as well as heating oil and diesel fuel as third main fraction of distillation which consists of paraffins with 12 to 18 carbon atoms and is used for diesel motors and purposes of heating. Gasoline from natural gas is also suitable, which represents the gasoline components present in natural gas and which were removed from the natural gas by compression or through absorption oil.

The above-mentioned aliphatic crude oil fractions are derived from a crude which contains mainly straight-chain paraffins. In addition, there are crudes (such as Soviet naphtha) which consists up to 80% of cyclic hydrocarbons (Naphthenes). The liquid naphthene fractions can also be utilized advantageously for the purpose of the invention. Among these fractions are, as most important representatives, cyclopentane, cyclohexane and cycloheptane.

Furthermore, crude oil fractions from such crudes are to be considered which assume a middle position between the "paraffinic" and the "naphthenic" crudes.

Finally, various aromatic compounds with low boiling points such as benzene, toluene and xylene are suitable as nonsolvents.

Manifold compounds and groups of compounds are to be considered as solvents. It will thereby by advantageous if the solvent exhibits a boiling point which lies under that of the nonsolvent. Detailed reasons for this are given hereinafter. Among the solvents, esters, ketones and alcohols are especially useful. Most suitable as solvents are: methyl acetate, ethyl acetate, isopropyl acetate, butyl acetate, acetone, methyl ethyl ketone, Methyl isobutyl ketone, methanol, ethanol, and propanol.

The composition of the combination solvent/nonsolvent is effected suitably such that the solvent evaporates first during evaporation of the mixture of solvents of the coating liquid which is applied to the carrier of the thermocolor ribbon. It is thereby assured that solvent capability of the dispersing agent of the applied coating liquid drops during progressive evaporation of the liquid portion and that finally, due to precipitation of solids of the the coating liquid, the solid layer of the melt-applied color is formed.

The type of coloring agents which are then incorporated into the completed melt-on color are not decisive for the desired effects. Inorganic as well as organic coloring agents in either natural or synthetic form can be considered. The inorganic coloring agents are pigments such as carbon black, and may have the character of a filler. Among the coloring agents are compounds soluble in solvents and/or binders. The following are enumerated by way of example: triphenyl methane pigments such as Victoria Blue (C. I. Basic Blue 26), Ink Blue (C. I. Acid Blue 93) and Water Blue TBA (C. I. Acid Blue 22), azo pigments such as Sudan Deep Black BB (C.I. Solvent Black 3) and Sudan Brown 1 (C. I. Solvent Brown 1), metal complex pigments such as Neozapon Black RE (C. I. Solvent Black 27) and Neozapon Blue FLE (C. I. Solvent Blue 70) and spirit-soluble pigments such as Spirit Blue (C. I. Solvent Blue 3) and Spirit Soluble Fast Black (C. I. Solvent Blue 70).

The coating liquid can be evaporated or reduced in any suitable manner, e.g. by applying warn air. In general, one can work at room temperature, where the application of the air will require more time. The determining factor is a coating liquid which contains the wax or waxlike substance in finest dispersion, namely, emulsified and/or suspended. It goes without saying, that the type of dispersion depends also on the system of solvent/nonsolvent, and the initial temperature.

In terms of technology, the invention can be explained as follows: due to the evaporation of the solvent/nonsolvent mixture, the nonsolvent becomes enriched during the liquid phase of the coating system and allows the structure substance of the thermoplastic resin to precipitate out continuously. During this precipitation process, the substances already present in solid form, e.g. the pigments or the other precipitated solids, are incorporated into the structure substance. During the transfer process, they act there as imperfection or nominal fracture points. By means of these nominal fracture points, it is achieved that, at the point, heated-up during the thermal printing process, not the entire color mass present, but only a fraction thereof is transferred. It is thus possible to produce a thermocolor ribbon transfer printing which can be reused more than 20 times. Such favorable results are unknown under the current state of the art.

The invention shall be explained in more detail through the following examples.

EXAMPLE 1

The following are melted at about 80° C. in a warm water bath: 17.2 g toluene, 10.4 g methyl ethyl ketone (MEK) (nonsolvent/solvent system), 6.8 g amide of oleic acid and 5.2 beeswax (meltable substance) as well as 6 g vinyl chloride-vinyl acetate copolymer, dissolved in 17. 8 g MEK, 1.8 g n-alkyl trimethyl diamine and 0.2 g commercial polyvinyl chloride stabilizer. The composition is then cooled to room temperature while being stirred. Thereupon, 6.2 g carbon black dispersed in 16. 4 methyl ethyl ketone and 23.2 g toluene are added. Then follows a 2-hour grinding at 200 rpm in a 250-mL ball mill which contains 400 g small steel balls. The resultant coating is applied to the carrier of a thermocolor ribbon in the shape of a polyester foil in a thickness of about 6 to 12 g/m$^2$ and is then subjected to evaporation of the solvent/nonsolvent system by being exposed to an air stream at 80° C.

EXAMPLE 2

The following are melted in a mater bath to form a homogenous system: 20 g toluene, 12 g methyl ethyl ketone, 8 g amide of oleic acid, 6 g of a special wax on a polyvinyl ether base (V-wax), 1 g N-alkyl trimethyl diamine and 7 g vinyl chloride/vinyl acetate copolymer dissolved in 21 g MEK and 0.2 g polyvinyl chlorine stabilizer. There follows stirring and cooling down to room temperature. Then there is added a dispersion of 40 g carbon black, 1.6 g triphenyl methane ink blue (pigment), 1.6 g triphenyl methane reflex blue (pigment), dispersed in 9.6 g methyl ethyl ketone and 18.2 g toluene. There follows a 2-hour grinding in a 250-g ball mill with a content of 400 g small steel balls at 200 rpm.

EXAMPLE 3

Initially, the following are melted in a water bath to become a homogenous system: 18 g toluene, 10.4 g methyl ethyl ketone, 12 g behenyl alcohol and 6 g vinyl chloride/vinyl acetate copolymer, dissolved in 17.8 g MEK as well as 0.2 polyvinyl chloride as stabilizer. There follows, while being stirred, a cooling down to room temperature. Thereto is added a dispersed system of 3.1 g carbon black, 3.1 g triphenyl methane reflex blue (pigment) and 16 g methyl ethyl ketone and 23.6 toluene. The follows the same grinding as in the preceding examples.

EXAMPLE 4

The following are melted into a homogeneous system in a water bath: 45 g toluene, 45 g ethyl alcohol, 12 g amide of oleic acid, 10 g vinyl chloride/vinyl acetate copolymer, dissolved in 30 g MEK, 0.2 g polyvinyl chloride as stabilizer, 5 g beeswax and 7.5 g azo pigment (C. I. Solvent Black 3). While stirring constantly, the coating mass is cooled down to room temperature. The grinding and coating is carried out as in the preceding examples.

We claim:

1. Process for the production of a reusable thermocolor ribbon for thermal printing having a plastic foil carrier provided on one side with a color layer, said color layer comprising a wax or wax-like substance, a coloring agent and a thermoplastic binding agent, said process comprising the steps of:

preparing a coating liquid containing said thermoplastic binding agent completely in solution and said meltable wax or wax-like substance in finely dispersed solid form, the ratio of wax or wax-like substance to binding agent being in a ratio from about 5:1 to 1:1 and the solids content initially present in said solution being about 20 to about 80% by weight, said solution being a mixture of a solvent and a non-solvent for said thermoplastic binding agent at room temperature, said solvent having a boiling point lower than that of said non-solvent;

applying said coating liquid to said plastic foil carrier;

evaporating said mixture of solvent and non-solvent such that the solvent capability for solubilizing the thermoplastic binding agent is concurrently reduced.

2. The process defined in claim 1 wherein said coating liquid is formed in step (a) to have a solids content of 30 to 60 percent by weight.

3. The process defined in claim 1 wherein said liquid mixture is formed from at least one solvent selected from the group which consists of esters, alcohols and ketones, and at least one nonsolvent selected from the group which consists of substituted and unsubstituted aromatic and aliphatic hydrocarbons.

4. The process defined in claim 1 wherein said coating liquid on said carrier foil is evaporated by exposure of the coating liquid on the carrier foil to a warm air stream.

* * * * *